US009280134B2

(12) United States Patent
Amano

(10) Patent No.: US 9,280,134 B2
(45) Date of Patent: Mar. 8, 2016

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Takafumi Amano, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/027,529

(22) Filed: Sep. 16, 2013

(65) Prior Publication Data

US 2014/0112684 A1 Apr. 24, 2014

(30) Foreign Application Priority Data

Oct. 22, 2012 (JP) ..... 2012-233270

(51) Int. Cl.
*G03G 21/18* (2006.01)
*G03G 15/08* (2006.01)

(52) U.S. Cl.
CPC ..... *G03G 21/1821* (2013.01); *G03G 15/0832* (2013.01); *G03G 21/1817* (2013.01); *G03G 2221/1853* (2013.01)

(58) Field of Classification Search
CPC ..... G03G 15/0832; G03G 15/0865; G03G 21/18; G03G 21/1817; G03G 2221/1853
USPC ..... 399/113, 262
See application file for complete search history.

(56) References Cited

U.S. PATENT DOCUMENTS

| | | | | |
|---|---|---|---|---|
| 5,585,889 | A * | 12/1996 | Shishido et al. | 399/113 |
| 5,612,768 | A * | 3/1997 | Kim et al. | 399/92 |
| 7,224,914 | B2 * | 5/2007 | Ushiroji et al. | 399/27 |
| 2004/0028424 | A1 * | 2/2004 | Yokoi | 399/90 |
| 2004/0037592 | A1 * | 2/2004 | Hiura et al. | 399/258 |
| 2004/0223790 | A1 * | 11/2004 | Hosokawa et al. | 399/258 |
| 2005/0008393 | A1 | 1/2005 | Kuma et al. | |
| 2008/0170875 | A1 * | 7/2008 | Kim et al. | 399/90 |
| 2009/0035024 | A1 * | 2/2009 | Sato | 399/262 |
| 2009/0086243 | A1 * | 4/2009 | Yamazaki | 358/1.13 |

FOREIGN PATENT DOCUMENTS

| | | |
|---|---|---|
| JP | 06-19227 | 1/1994 |
| JP | 2003-156988 | 5/2003 |
| JP | 2005-049553 | 2/2005 |
| JP | 2007-199505 | 8/2007 |
| JP | 2011-034014 | 2/2011 |

OTHER PUBLICATIONS

Office Action of Notification of Reason(s) for Refusal for Japanese Patent Application No. 2012-233270 Dated Aug. 19, 2014, 3 pgs.

* cited by examiner

*Primary Examiner* — Benjamin Schmitt
(74) *Attorney, Agent, or Firm* — Turocy & Watson, LLP

(57) ABSTRACT

An image forming apparatus includes a toner cartridge which is detachably mounted from a first direction to store a toner; and a processing unit which is detachably mounted from a second direction perpendicular to the first direction and is provided with a photoconductor, a developing section for supplying a toner fed from the toner cartridge to the surface of the photoconductor to convert an electrostatic latent image to a toner image and a cleaning section for collecting the toner adhered on the surface of the photoconductor.

3 Claims, 12 Drawing Sheets

IMAGE FORMING APPARATUS

CROSS-REFERENCE TO RELATED APPLICATION

This application is based upon and claims the benefit of priority from Japanese Patent Application No. 2012-233270, filed Oct. 22, 2012, the entire contents of which are incorporated herein by reference.

FIELD

Embodiments described herein relate to a technology in which an image forming apparatus provided with a processing unit is downsized.

BACKGROUND

Conventionally, there is a processing unit in which a developing unit (a unit having a toner cartridge) is integrated with a photoconductive drum and which is detachable from a main body of an image forming apparatus so that a user can exchange the developing unit and the photoconductive drum without the help of a serviceman (Japanese Unexamined Patent Application Publication No. Hei 8-16072 and Japanese Unexamined Patent Application Publication No. 2005-275341). The image forming apparatuses provided with a processing unit include an image forming apparatus which, for the sake of the operation of a user when exchanging the processing unit, has an opening for inserting and detaching a processing unit on the front wall thereof.

BRIEF DESCRIPTION OF THE DRAWINGS

FIG. 7 (B) is an illustration diagram illustrating an operation of detaching a toner cartridge in the image forming apparatus shown in FIG. 7 (A);

FIG. 8 (B) is a schematic diagram illustrating a state in which a conveyance path cover section shown in FIG. 1 is exposed;

FIG. 9 (B) is an X-Z section view of a toner cartridge when a processing unit is detached from the state shown in FIG. 8 (B) and the surroundings of a charger;

DETAILED DESCRIPTION

In accordance with one embodiment, an image forming apparatus includes a toner cartridge which is detachably mounted from a first direction to store a toner; and a processing unit which is detachably mounted from a second direction perpendicular to the first direction and is provided with a photoconductor, a developing section for supplying a toner fed from the toner cartridge to the surface of the photoconductor to convert an electrostatic latent image to a toner image and a cleaning section for collecting the toner adhered on the surface of the photoconductor.

Figure 1:
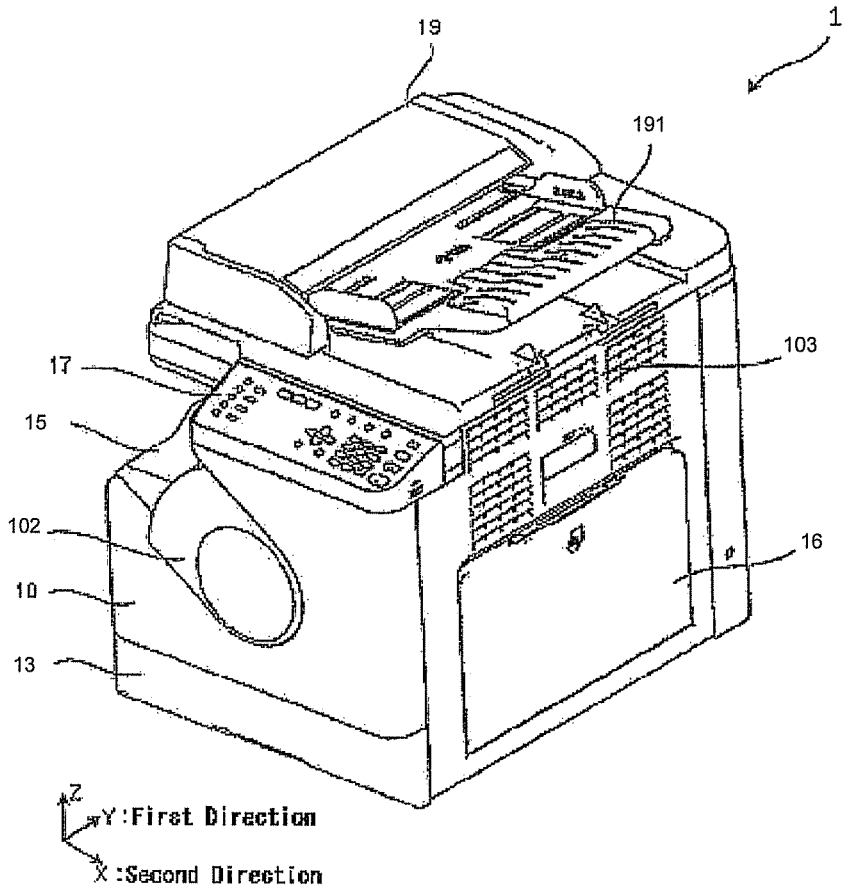
FIG. 1 is a perspective view illustrating the whole image forming apparatus according to an embodiment.
Figure 2:
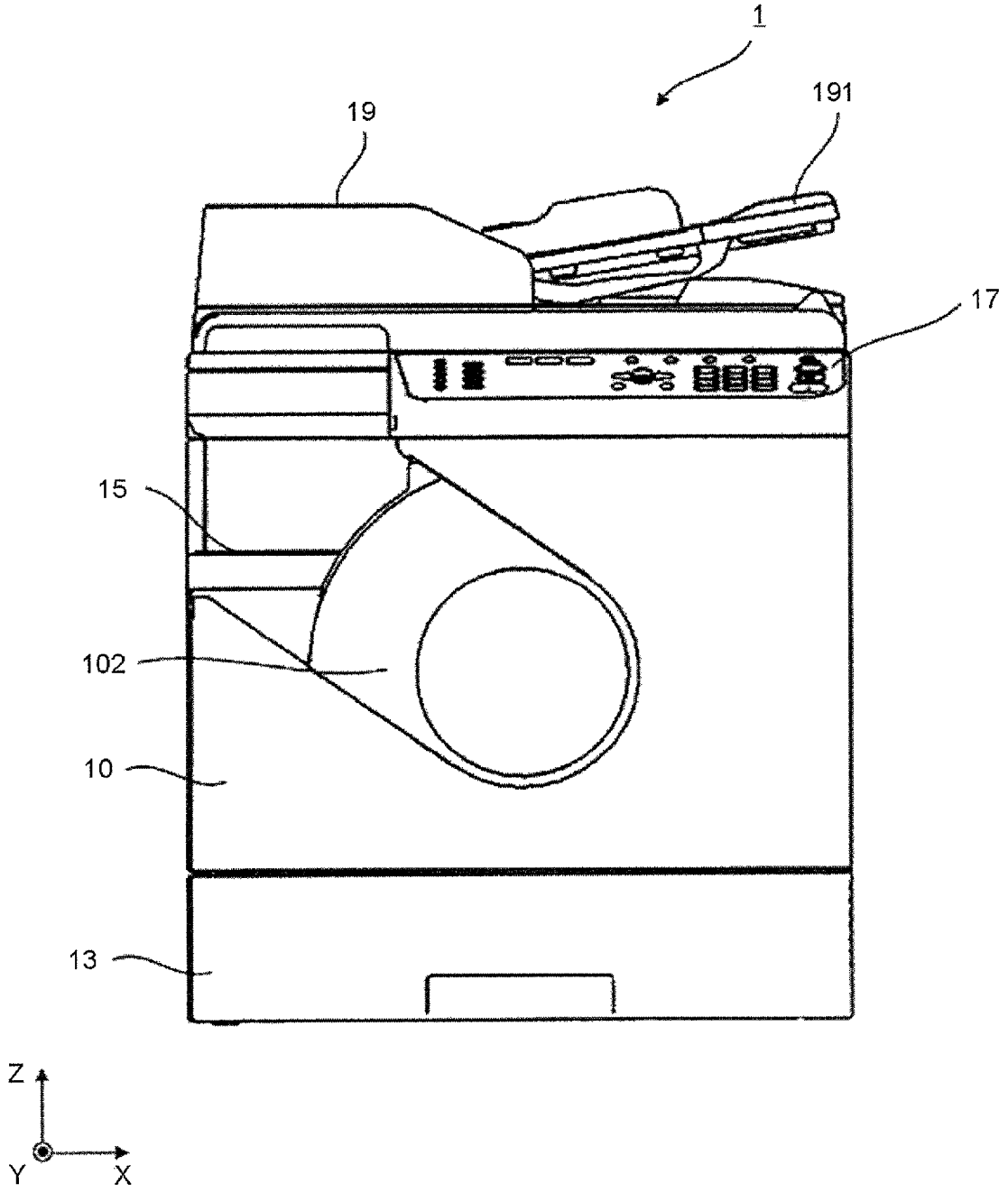
FIG. 2 is a front view of the image forming apparatus shown in FIG. 1.
Figure 3:
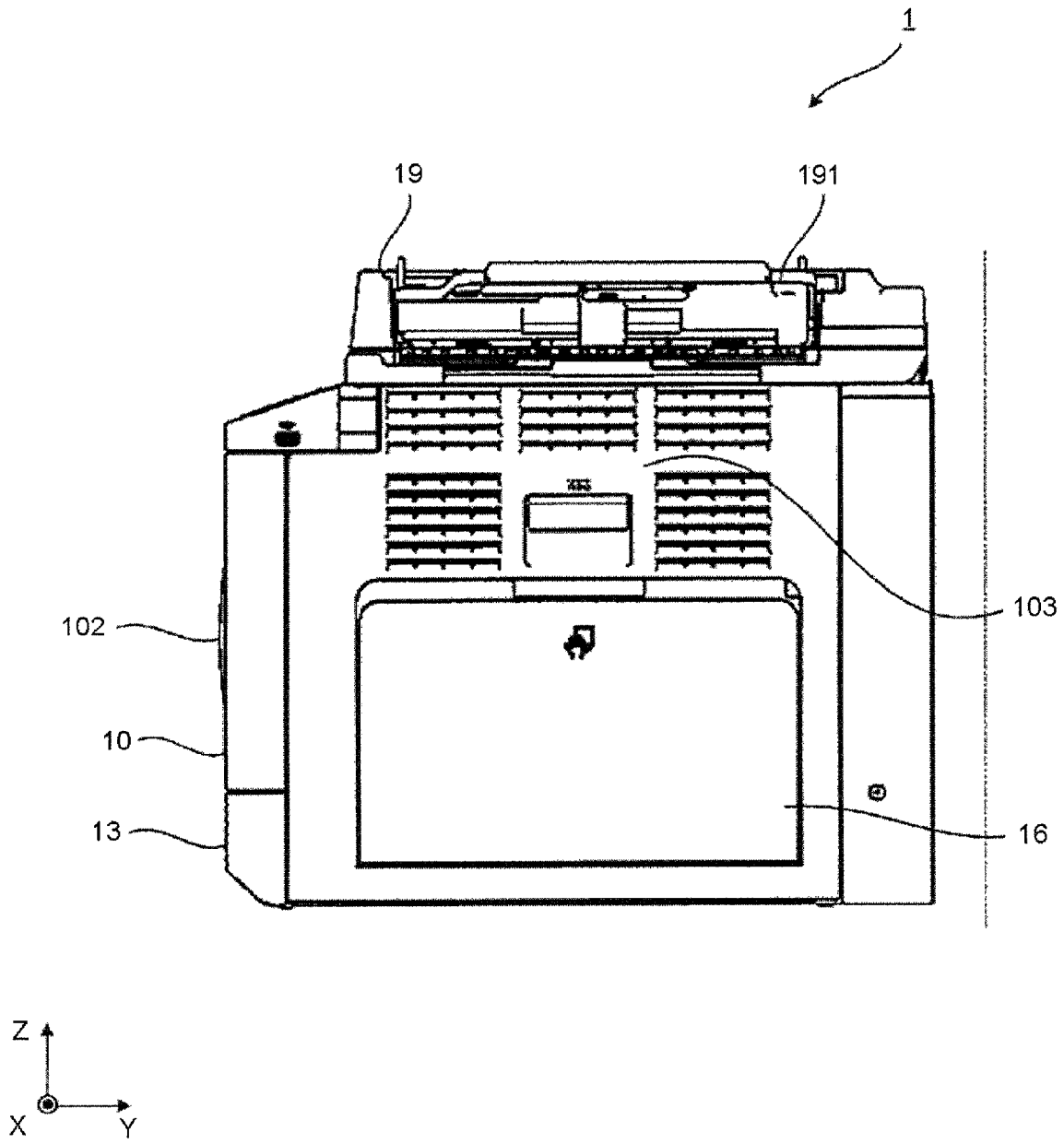
FIG. 3 is a right side view of the image forming apparatus shown in FIG. 1.
Figure 4:
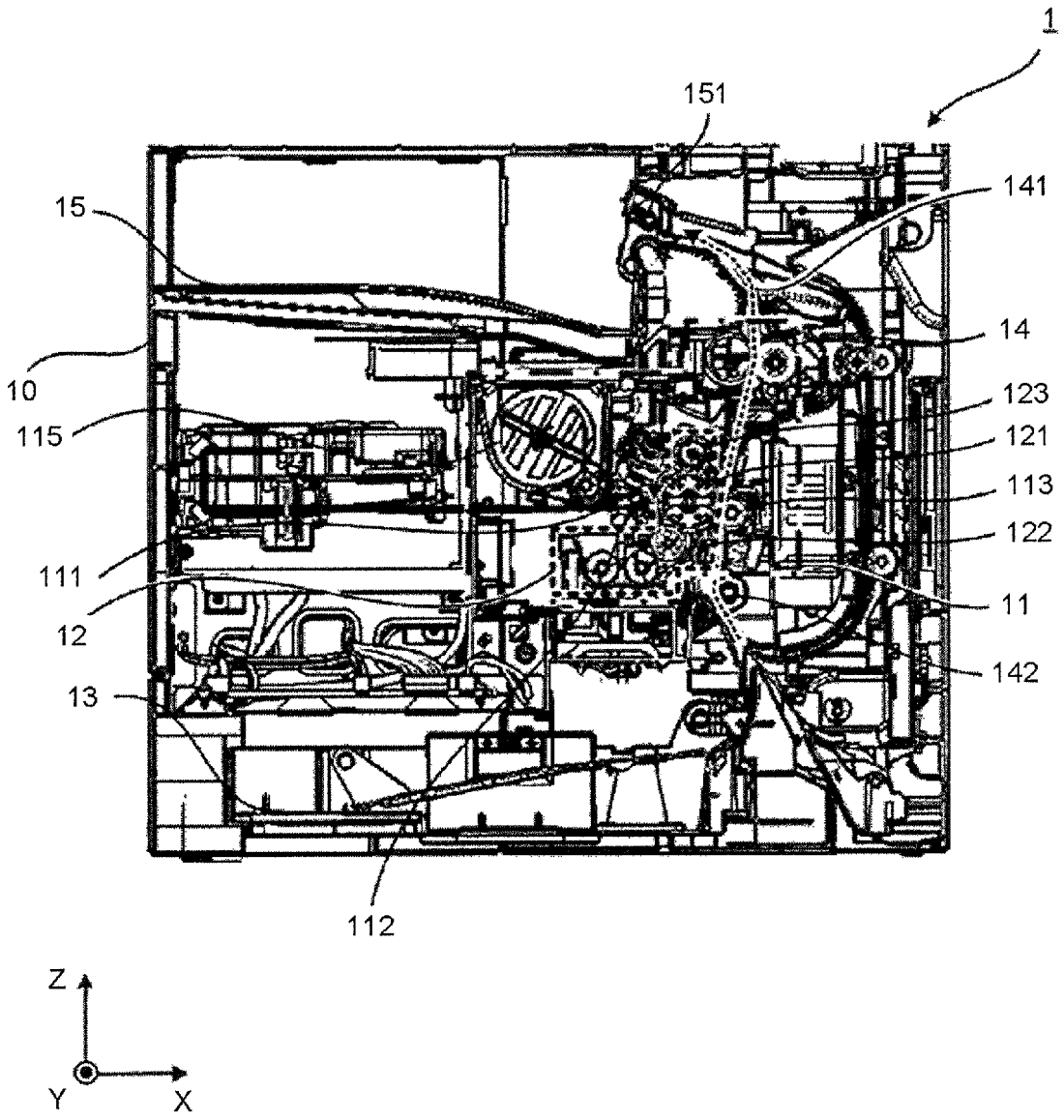
FIG. 4 is an X-Z section view of the image forming apparatus shown in FIG. 2 in which an auto document feeder is saved.

An image forming apparatus 1 according to an embodiment is described below with reference to accompanying drawings. FIG. 1 is a perspective view illustrating the whole image forming apparatus 1 according to an embodiment, FIG. 2 is a front view of the image forming apparatus 1 shown in FIG. 1, FIG. 3 is a right side view of the image forming apparatus 1 shown in FIG. 1, and FIG. 4 is an X-Z section view of the image forming apparatus 1 shown in FIG. 2 in which an auto document feeder 19 is saved. Further, the width direction of the image forming apparatus 1 is set to be an X axis, the depth direction of the image forming apparatus 1 is set to be a Y axis, and the height direction of the image forming apparatus 1 is set to be a Z axis.

As shown in FIG. 1-FIG. 4, a multi-function peripheral (MFP: Multi-Function Peripheral) serving as the image forming apparatus 1 in an embodiment feeds, one by one, sheets stored in a paper feed section 13 at the internal bottom of the main body 10 of the image forming apparatus to a conveyance path 141, conveys the sheets upwards with a conveyance roller 142, and discharges the sheets from a paper discharging roller 151 to a discharged paper receiving section 15 arranged in the middle of the main body 10 of the image forming apparatus. Further, when a manually loaded sheet is used in the image forming apparatus 1, the sheet loaded in a manual sheet loading section 16 is conveyed by the conveyance roller 142 and, as described above, discharged to the discharged paper receiving section 15.

An image forming section 11 (the part represented by the one dotted lines shown in FIG. 4) is arranged in the conveyance path 141. As shown in FIG. 4, the image forming section 11 comprises a photoconductor 121, which has a photoconductive layer on the surface thereof, rotating in a direction shown by the arrow in FIG. 4, and a charger 111 for uniformly charging the surface of the photoconductor 121, an exposure section 112 for exposing the photoconductive layer uniformly charged by the charger 111 to form an electrostatic latent image, a developing section 122 for developing the electrostatic latent image formed through the exposure by the exposure section 112 with a toner and visualizing the electrostatic latent image, a transfer section 113 for transferring the toner image visualized by the developing section 122 to a sheet and a cleaning section 123 for collecting the charged toner on the sheet left by the transfer section 113 are arranged around the photoconductor 121. Further, the image forming section 11 comprises a heat fixer 114 for heating and fixing the toner image transferred to the sheet by the transfer section 113.

Further, as shown in FIG. 1 and FIG. 4, an operation panel 17 which is arranged in a direction (hereinafter referred to as a first direction) facing the front side of the image forming apparatus 1 and is provided with various operation keys and a liquid crystal display, an image reading section 18 for reading an image printed on a sheet and an auto document feeder 19 (ADF: Auto Document Feeder) for feeding sheets to the image reading section 18 automatically are arranged on the upper portion of the main body 10 of the image forming apparatus. Moreover, the auto document feeder 19 comprises an extension sheet loading section 191 which will be described later.

The image forming section 11 has a toner cartridge 115 for storing a toner and feeding the toner to the developing section 122. The toner cartridge 115 is detachably mounted on the main body 10 of the image forming apparatus from the direction (a first direction) of the wall of the image forming apparatus 1 on which the operation panel 17 is arranged.

As shown in FIG. 1 and FIG. 2, an opening 101 from which the toner cartridge 115 is placed in or taken out and an opening cover 102 for covering the opening 101 are arranged on the front wall (the wall in the first direction) of the main body 10 of the image forming apparatus. The opening cover 102 is detachably mounted on the opening 101. Herein, the opening cover 102 may be colored or engraved with a logo according to the willing of a user. With the constitution, a unique opening cover 102 can be used for different user in the main body 10 of the image forming apparatus, which makes the user have a sense of emotional attachment to the personal image forming apparatus 1.

Figure 5:
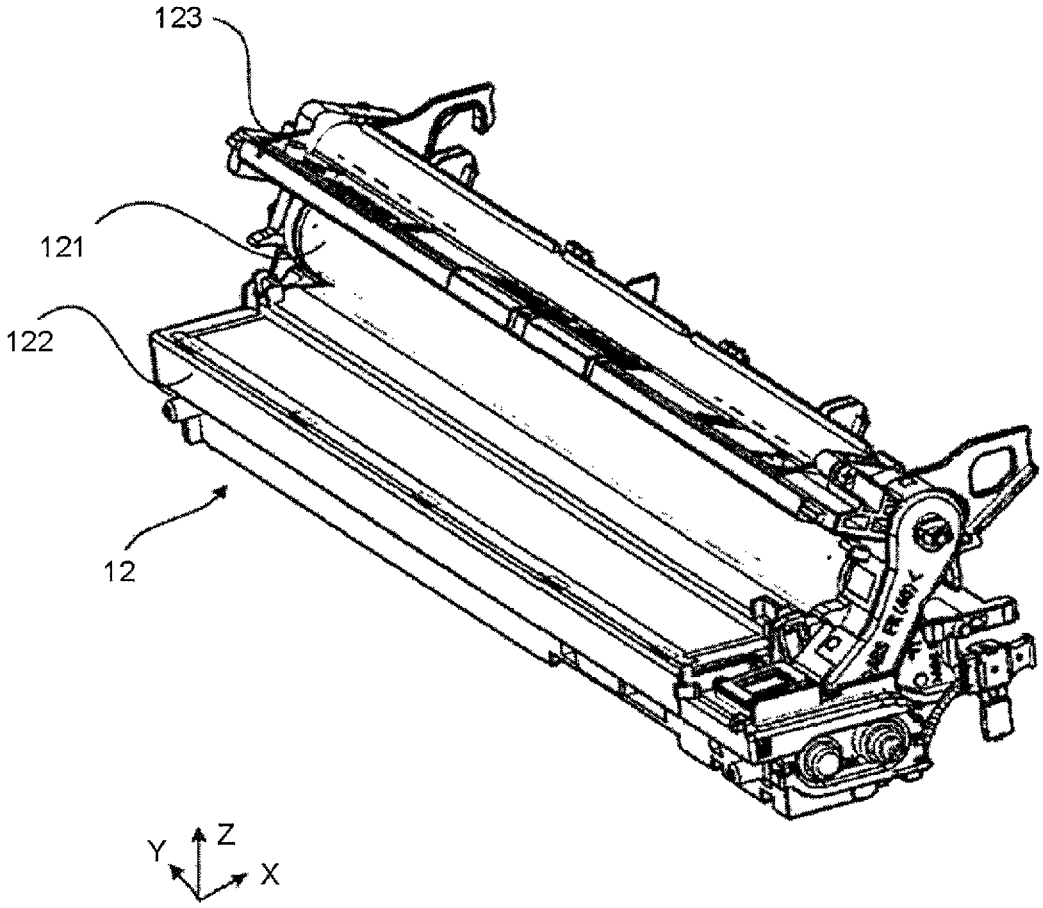
FIG. 5 is a schematic diagram illustrating the processing unit of the image forming apparatus shown in FIG. 1.

FIG. 5 is a schematic diagram illustrating a processing unit 12 of the image forming apparatus 1 shown in FIG. 1. The processing unit 12 consisting of the photoconductor 121, the developing section 122 and the cleaning section 123 is a constitution which can be integrally detached from a second direction (e.g. the direction of the right wall of the main body 10 of the image forming apparatus) perpendicular to the first direction in the main body 10 of the image forming apparatus.

As Shown in FIG. 1 and FIG. 3, a conveyance path cover section 103, which rotates between an opening position where the conveyance roller 142 and the conveyance path 141 (hereinafter collectively referred to as a conveyance section 14) and a closing position where the conveyance section 14 is covered, is arranged on the right wall (the wall in the second direction perpendicular to the first direction) of the main body 10 of the image forming apparatus. The conveyance path cover section 103 is rotated to the opening position to pull the processing unit 12 out in the second direction to detach the processing unit 12 from the main body 10 of the image forming apparatus.

The conveyance path cover section 103 is not only used for taking out the processing unit 12, the conveyance path cover section 103, when rotated to the opening position, may further be used to take out a sheet jammed in the conveyance path 141 in a jam processing or a component different from the processing unit 12. With the constitution, the conveyance path cover section 103 can serve as an outlet for taking out the processing unit 12 and other components or an access opening for accessing the image forming apparatus 1 during a jam processing.

Figure 6:
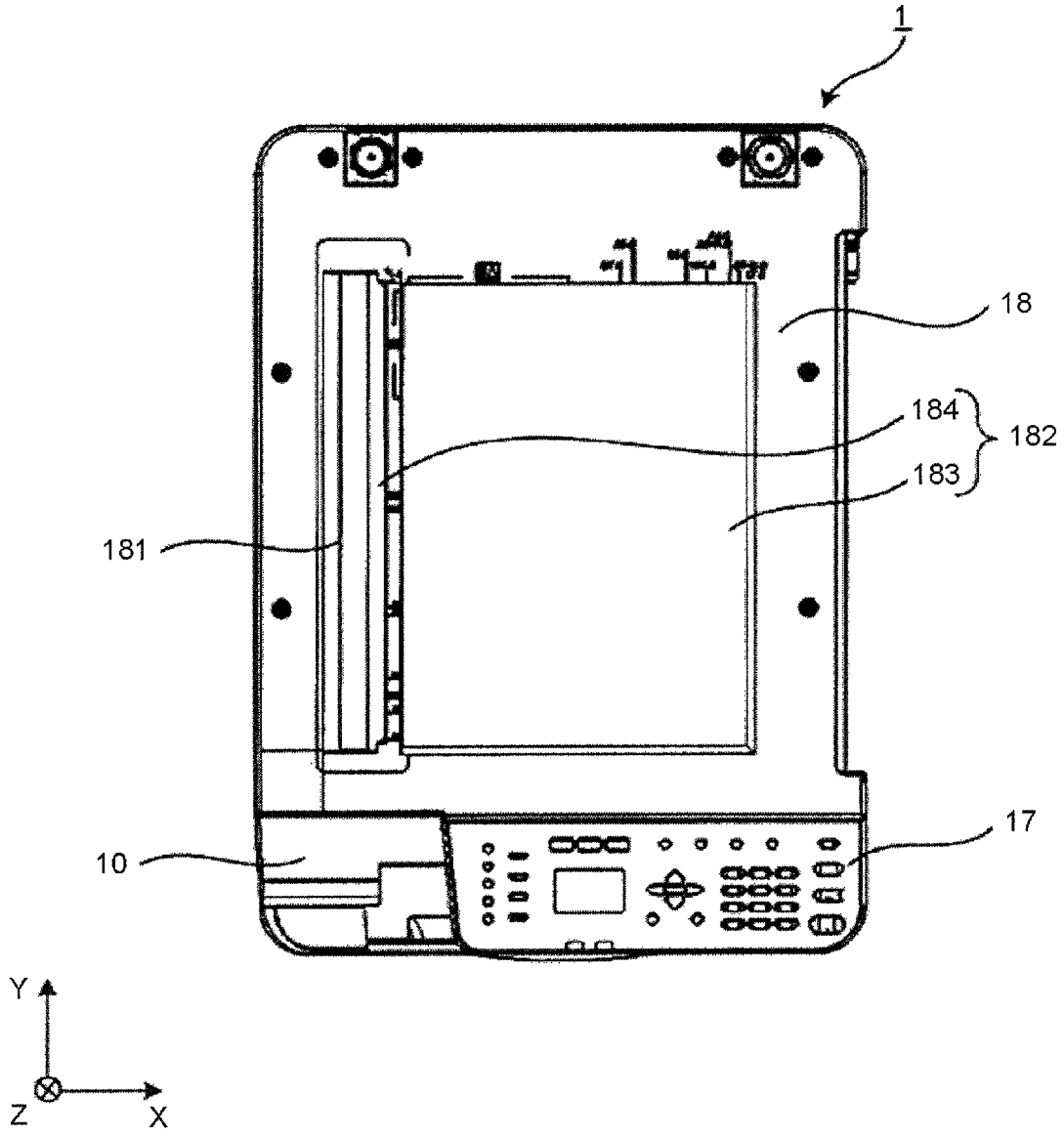
FIG. 6 is a top view of the image forming apparatus shown in FIG. 1 in which an auto document feeder is saved.

FIG. 6 is a top view of the image forming apparatus 1 shown in FIG. 1 in which the auto document feeder 19 is saved. The image reading section 18 comprises a reading section 181 for reading an image printed on a sheet and a platen glass 182 (transparent component) arranged on a document platform. In an area where the platen glass 182 is arranged, there is a still document reading area 183 where a sheet is loaded and an image is read when the reading section 181 is used as a flat head scanner and a moving document reading area 184 where a document passes when an image is read using the auto document feeder 19. Herein, as shown in FIG. 6, the still document reading area 183 is of a rectangular shape in plan view and is capable of carrying a sheet having a size not greater than A4 (letter size), and the moving document reading area 184 is an elongated area along the longitudinal direction of the still document reading area 183.

Figure 7:
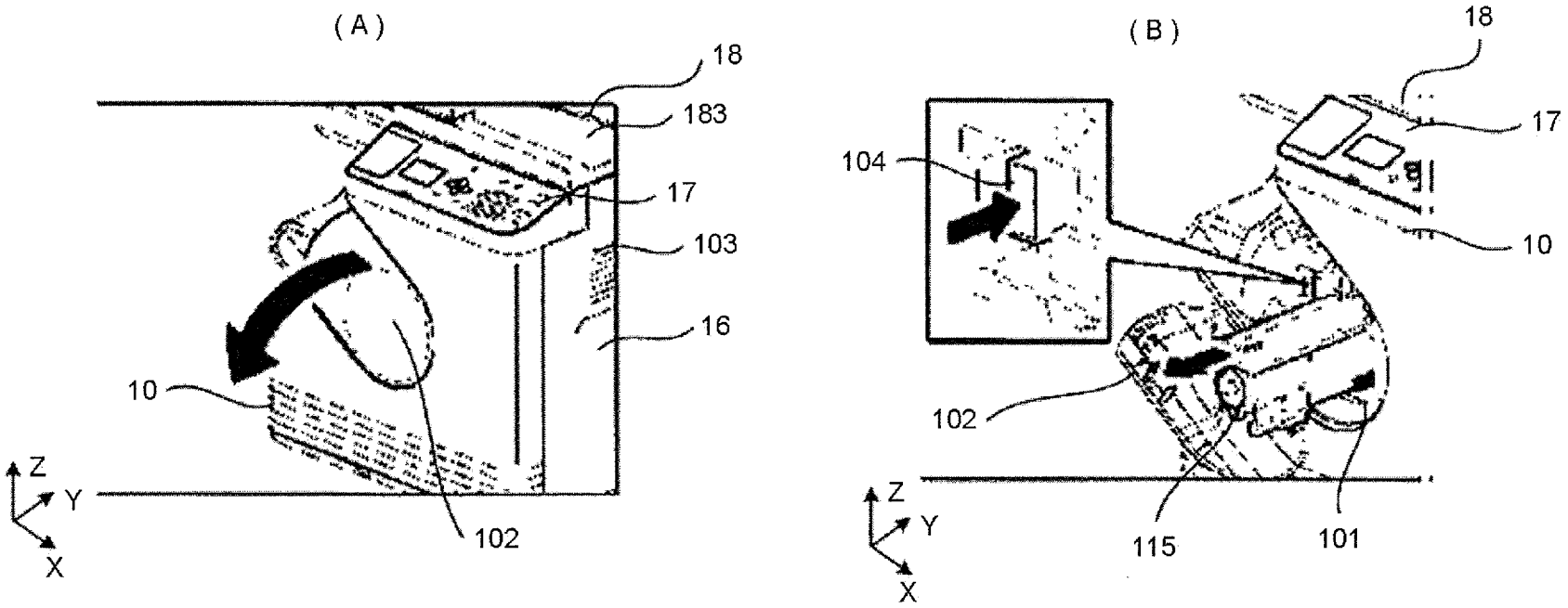
FIG. 7 (A) is an illustration diagram illustrating an operation of uncovering an opening cover in the image forming apparatus shown in FIG. 1.

Next, a method for exchanging the toner cartridge 115 inserted in the main body 10 of the image forming apparatus is described below. FIG. 7 (A) is an illustration diagram illustrating an operation of uncovering the opening cover 102 in the image forming apparatus 1 shown in FIG. 1, and FIG. 7 (B) is an illustration diagram illustrating an operation of detaching the toner cartridge 115 in the image forming apparatus 1 shown in FIG. 7 (A).

As shown in FIG. 7 (A), a user uncovers the opening cover 102 from the opening 101. As shown in FIG. 7 (B) a user pulls the used toner cartridge 115 out in the first direction to detach the used toner cartridge 115 from the main body 10 of the image forming apparatus. The toner cartridge 115 can be detached from the main body by pressing a detach button 104 arranged around the opening 101, as shown in FIG. 7 (B). After the toner cartridge 115 is detached from the main body 10 of the image forming apparatus, a user inserts an unused toner cartridge 115 through the opening 101. If the toner cartridge 115 is inserted at a specific position in the image forming apparatus 1, then the user mounts the opening cover 102 on the opening 101 and then the exchanging job of the toner cartridge 115 is ended.

Figure 8:
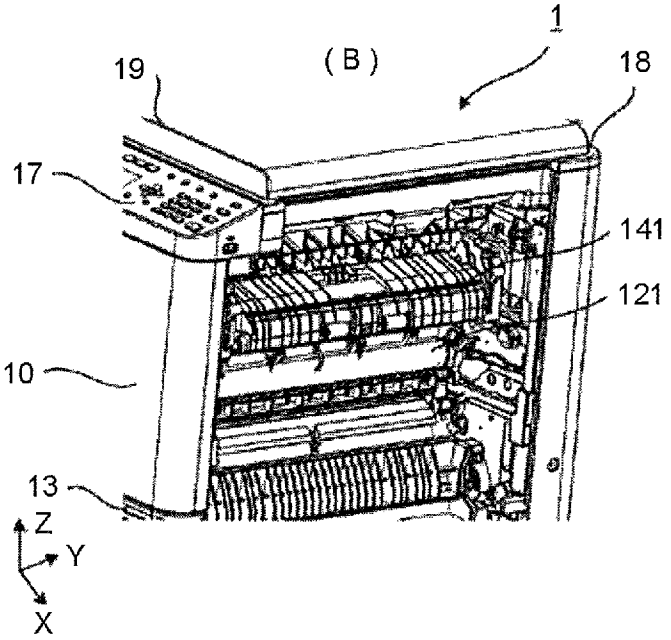
FIG. 8 (A) is an illustration diagram illustrating an operation of rotating a conveyance path cover section shown in FIG. 1 to an opening position.
Figure 8:
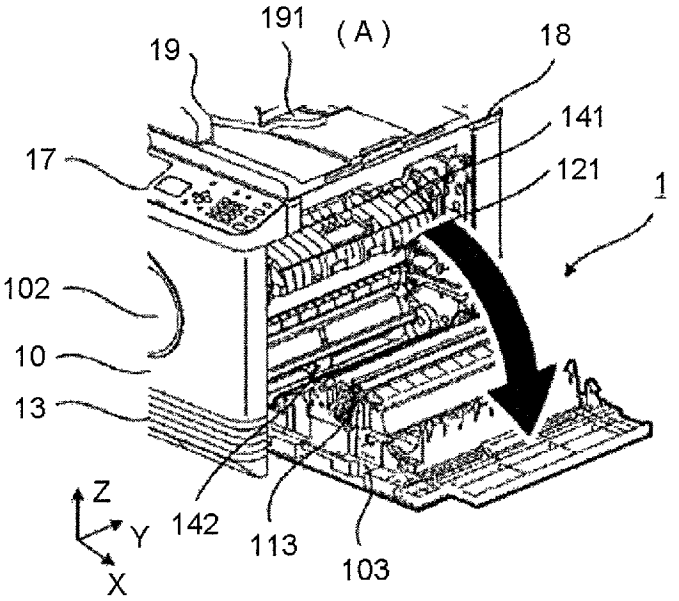
Figure 9:
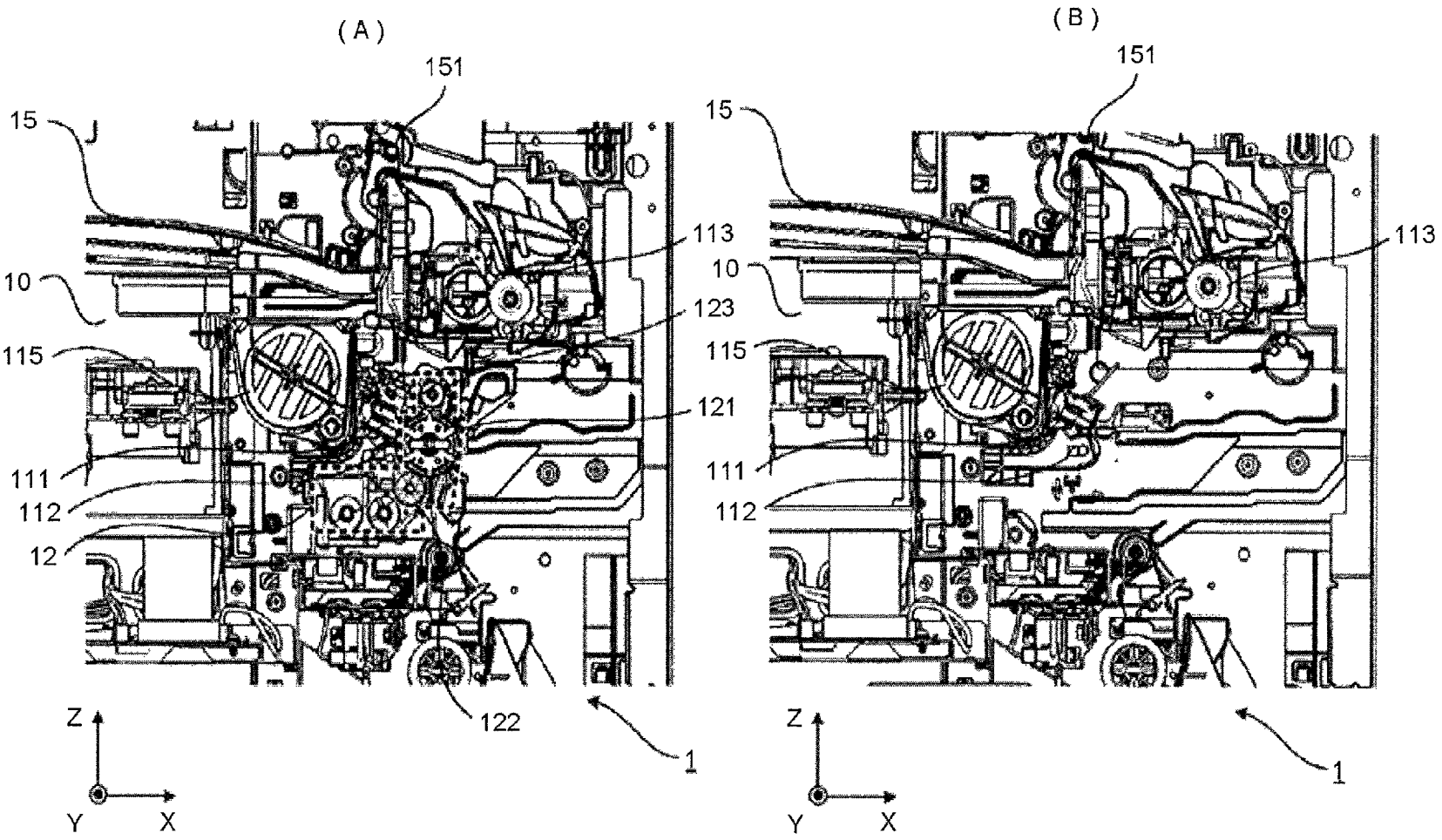
FIG. 9 (A) is an X-Z section view of a toner cartridge in the state shown in FIG. 8 (B) and the surroundings of a charger.
Figure 10:
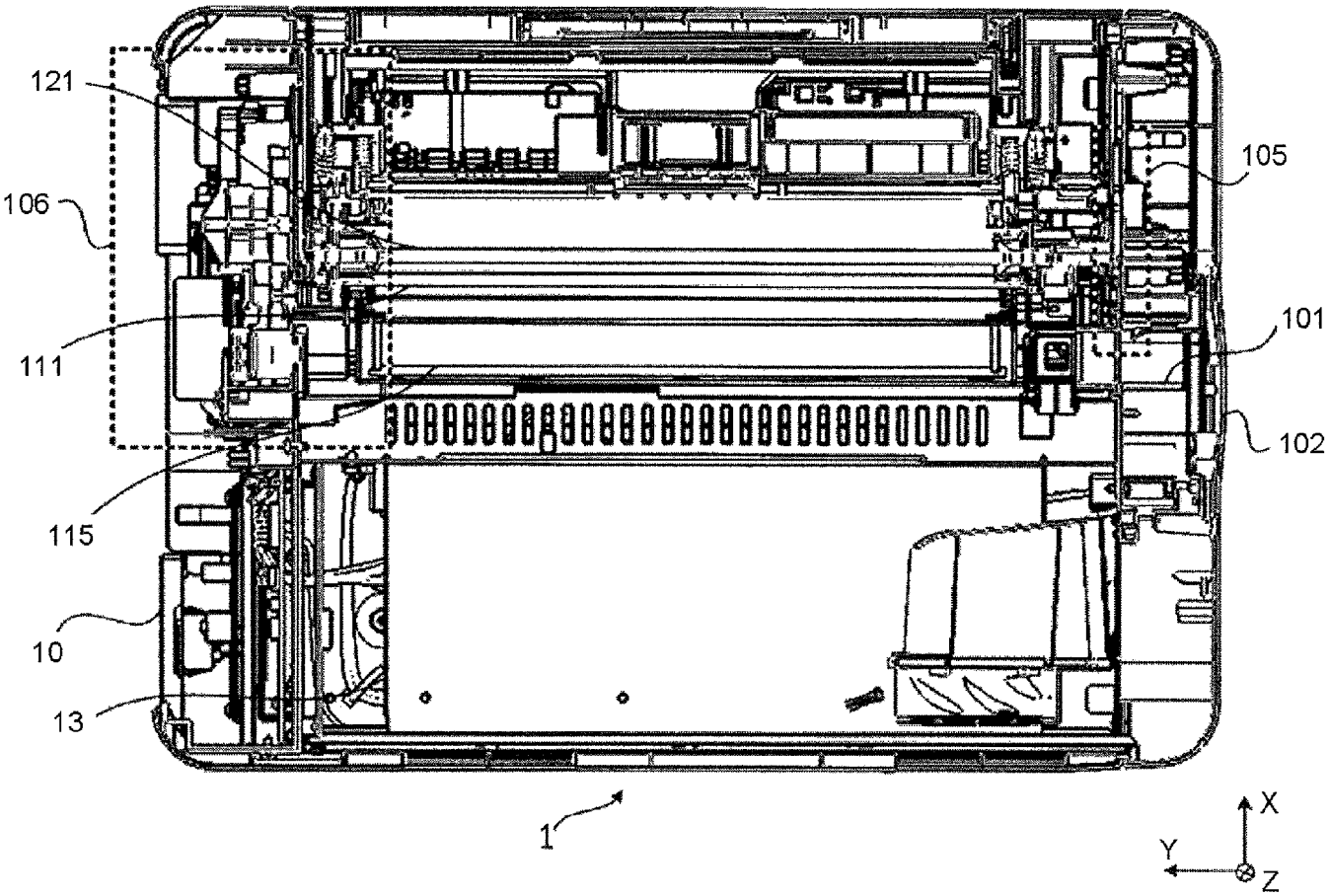
FIG. 10 is an X-Y section view of the image forming apparatus shown in FIG. 1.

Next, a method for exchanging the processing unit 12 mounted on the main body 10 of the image forming apparatus is described below. FIG. 8 (A) is an illustration diagram illustrating an operation of rotating the conveyance path cover section 103 shown in FIG. 1 to the opening position; FIG. 8 (B) is a schematic diagram illustrating a state in which the conveyance path cover section 103 shown in FIG. 1 is exposed; FIG. 9 (A) is an X-Z section view of the toner cartridge 115 in the state shown in FIG. 8 (B) and the surroundings of the charger 111; FIG. 9 (B) is an X-Z section view of the toner cartridge 115 when the processing unit 12 is detached from the state shown in FIG. 8 (B) and the surroundings of the charger 111; and FIG. 10 is an X-Y section view of the image forming apparatus 1 shown in FIG. 1.

As shown in FIG. 8(A), a user rotates the conveyance path cover section 103 to the opening position. As shown in FIG. 8 (B), if the conveyance section 14 is exposed, then a user pulls the processing unit 12 shown in FIG. 5 out in the second direction to take the used processing unit 12 out from the main body 10 of the image forming apparatus.

Herein, as the charger 111 is not included in the processing unit 12, the charger 111 is still mounted on the main body 10 of the image forming apparatus even if the processing unit 12 is taken out from the main body 10 of the image forming apparatus. Specifically, before the processing unit 12 is taken out, the photoconductor 121, the developing section 122, the cleaning section 123 and the charger 111 are respectively arranged on the main body 10 of the image forming apparatus, as shown in FIG. 9 (A), and after the processing unit 12 is take out, only the charger 111 is arranged on the image forming apparatus 1, as shown in FIG. 9 (B).

As the processing unit 12 and the charger 111 are configured respectively, the processing unit 12 can be exchanged with a new one when, for example, the photoconductor 121 in the processing unit 12 is faulted. That is, in this case, there is no need to detach the charger 111 arranged on the main body 10 of the image forming apparatus 1 described in the present embodiment to exchange the charger 111 with a new one.

Thus, the charger 111, which is longer in service life than the photoconductor 121 and the like, can still be used after the processing unit 12 is exchanged. Further, on the contrary, if only the charger 111 is faulted, then only the charger 111 is exchanged with a new one, without exchanging the processing 12 mounted on the main body 10 of the image forming apparatus, which saves the cost for the exchanging of the processing unit 12.

After the used processing unit 12 is taken out from the main body 10 of the image forming apparatus, a user mounts a new processing unit 12 at a specific position of the main body 10 of the image forming apparatus, sets the conveyance path cover section 103 at the closing position, and then ends the exchanging operation of the processing unit 12.

As stated above, according to the present embodiment, the toner cartridge 115 and the processing unit 12 of the image forming apparatus 1 are configured respectively, thus, the toner cartridge 115 can be exchanged without taking the processing unit 12 out from the main body 10 of the image forming apparatus. That is, in the image forming apparatus 1 described herein, the toner cartridge 115 can be exchanged respectively, and the processing unit 12 can be exchanged respectively as well.

Further, in the image forming apparatus 1 described in the present embodiment, a user can use the opening 101 formed on the front wall (the wall in the first direction in the main body 10 of the image forming apparatus) of the main body 10 of the image forming apparatus where the user can carry out an operation easily to exchange the toner cartridge 115, which makes the exchanging operation of the toner cartridge 115 easier.

Further, in the image forming apparatus 1 described in the present embodiment, the processing unit 12, which is exchanged less frequently than the toner cartridge 115, is exchanged using the conveyance path cover section 103 arranged on the right wall (the wall of the main body 10 of the image forming apparatus in the second direction) of the image forming apparatus 1, thus, the opening area on the front wall of the main body 10 of the image forming apparatus is reduced. That is, with the constitution that only the frequently-exchanged toner cartridge 115 is taken out from the front wall of the main body 10 of the image forming apparatus, the efficiency of the exchanging operation by the user is enhanced, and the strength of the front wall (the wall of the image forming apparatus in the first direction) of the main body 10 of the image forming apparatus is enhanced.

With the constitution, in the image forming apparatus 1 of the present embodiment, as the strength of the front wall of the main body 10 of the image forming apparatus can be enhanced, the length in the width direction (the length in the direction of the X axis) of the main body 10 of the image forming apparatus can be reduced.

Further, a space for the arrangement of various apparatuses can be set nearby the front wall of the image forming apparatus 1 described in the present embodiment since the opening area on the front wall of the main body 10 of the image forming apparatus is reduced. By arranging various apparatuses in the space, the main body 10 of the image forming apparatus is downsized.

Specifically, the power supply section 105, which is conventionally arranged on the back wall of the image forming apparatus 1 to respectively supply power to the toner cartridge 115, the photoconductor 121, the developing section 122, the cleaning section 123 and the charger 111, may be arranged in the space nearby the front wall of the image forming apparatus according to the present invention.

That is, as shown in FIG. 10, in the image forming apparatus 1 described in the present embodiment, a power supply section 105 is arranged nearby the front wall of the main body 10 of the image forming apparatus, and a drive section 106 for respectively driving the toner cartridge 115, the photoconductor 121, the developing section 122, the cleaning section 123 and the charger 111 is arranged nearby the back side of the main body 10 of the image forming apparatus. With the constitution, the image forming apparatus 1 described in the present embodiment has a shorter length in the depth direction (Y axis direction) when compared with the conventional image forming apparatus 1 in which a power supply section 105 and a drive section 106 are arranged nearby the back wall of the image forming apparatus.

Figure 11:
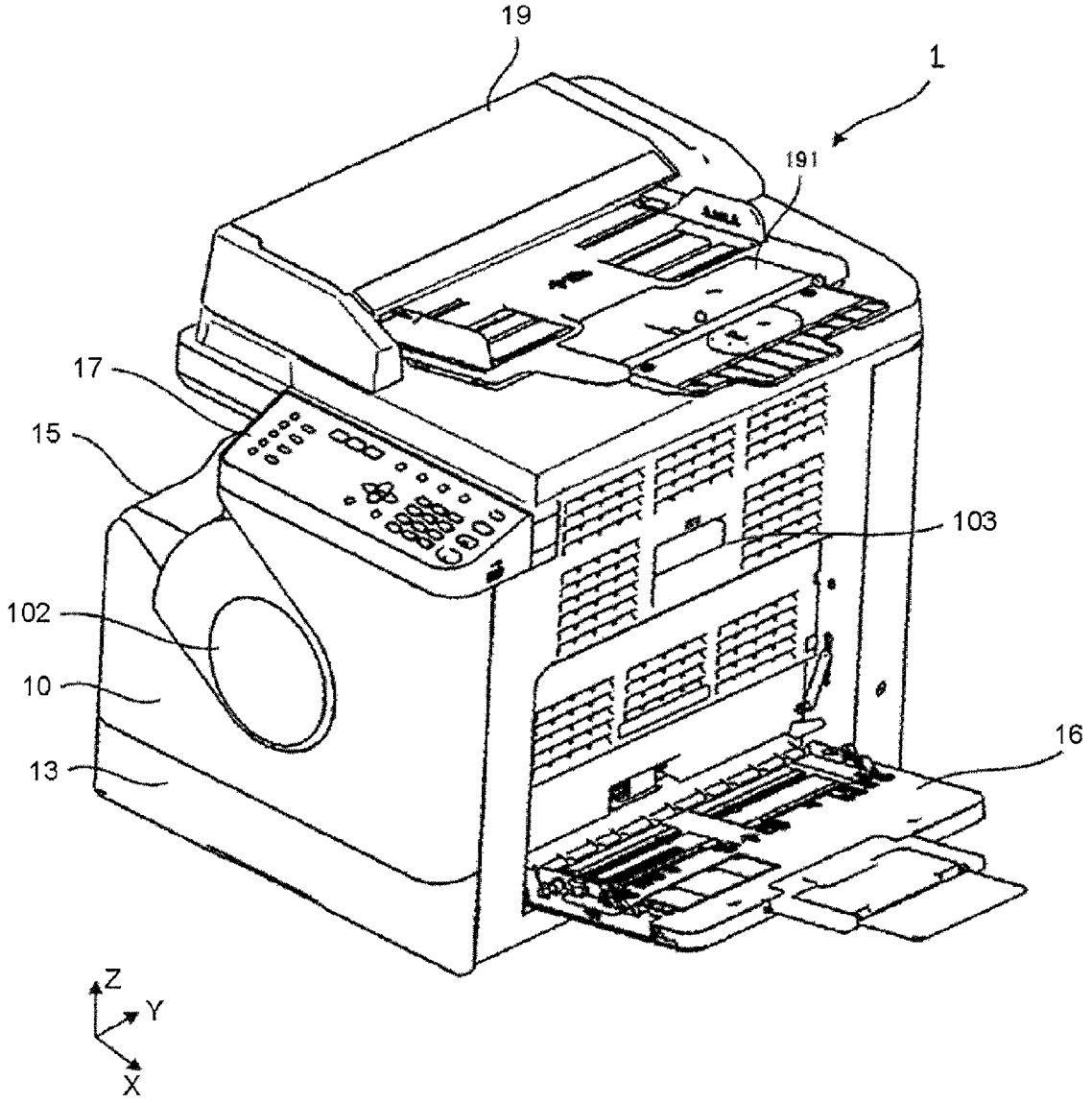
FIG. 11 is a perspective view illustrating a state in which an extension sheet loading section and a manual sheet loading section of an image forming apparatus are pulled out according to an embodiment.

Next, a method for reading an image printed on a sheet of A3 size (a sheet larger than the still document reading area 183) and a method for forming an image on the sheet of A3 size (a sheet larger than the sheet stored in the paper feed section 13) are described. Herein, the size of the sheet which can be stored in the paper feed section 13 is set as A4 letter size. FIG. 11 is a perspective illustrating a state in which the extension sheet loading section 191 and the manual sheet loading section 16 of an image forming apparatus 1 are pulled out according to the present embodiment, and FIG. 12 is the front view of the image forming apparatus 1 in the state shown in FIG. 11.

Figure 12:
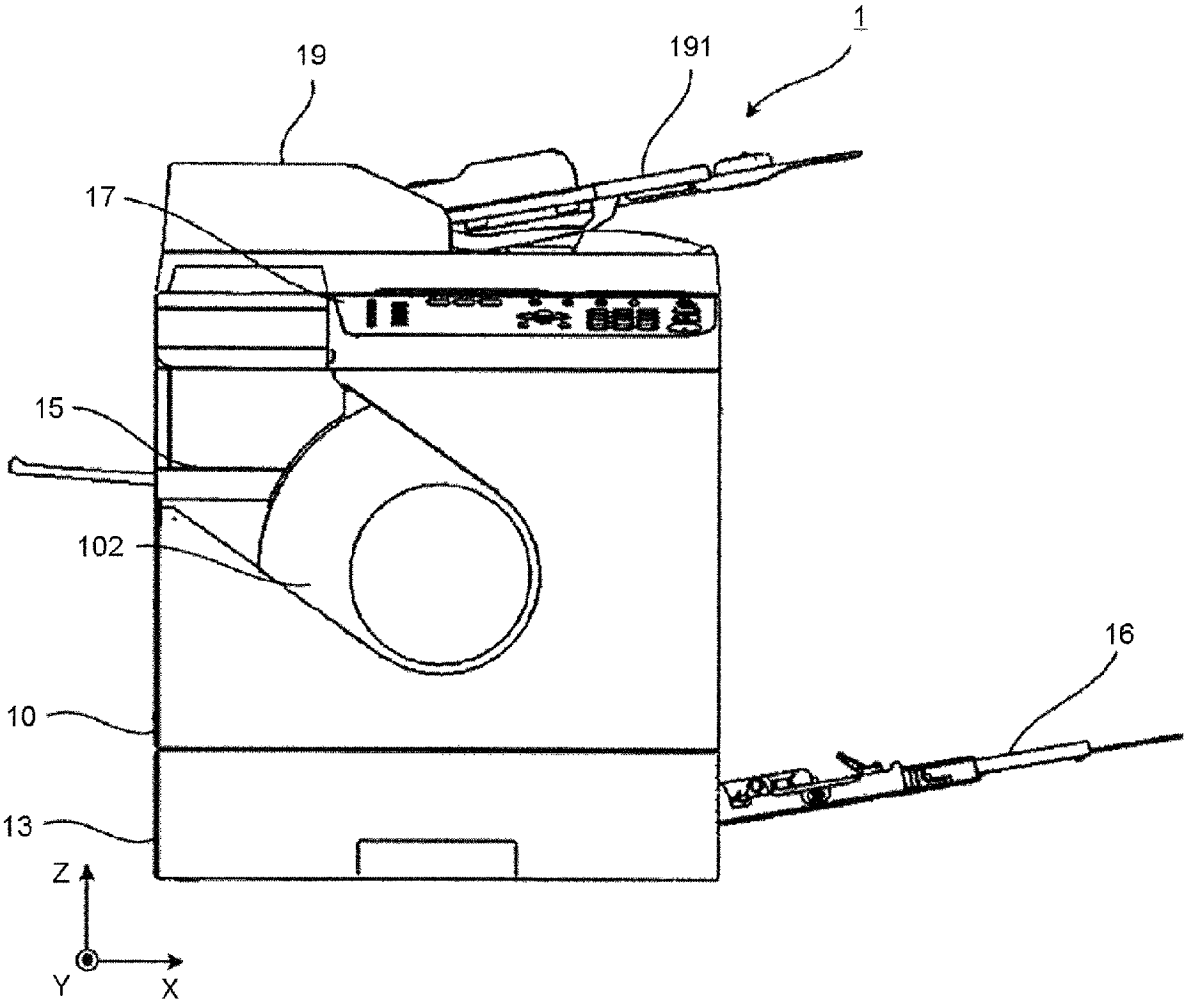
FIG. 12 is a front view of the image forming apparatus in the state shown in FIG. 11.

As shown in FIG. 11 and FIG. 12, the user pulls the extension sheet loading section 191 out to read an image printed on a sheet of A3 size. Then, the sheet loaded on the extension sheet loading section 191 is conveyed to the moving document reading area 184 by the auto document feeder 19, and the image printed on the sheet is read by the reading section 181. The sheet the image of which is read is discharged to the discharged paper receiving section 15.

With the constitution above, in the image forming apparatus 1 of the present embodiment, even if the still document reading area 183 is of the A4 letter size, the image printed on a sheet having a size larger than the still document reading area 183 (e.g. a sheet of A3 size) can be read by the reading section 181 using the auto document feeder 19.

As shown in FIG. 11 and FIG. 12, the user pulls out the manual sheet loading section 16 to load a sheet, when an image is formed on a sheet of A3 size. If the image forming apparatus 1 starts an image formation operation, then the sheet loaded in the manual sheet loading section 16 is conveyed by the conveyance roller 142, the toner image developed on the photoconductor 121 is transferred to the sheet by the transfer section 113, and the sheet is discharged to the discharged paper receiving section 15 after passing the heat fixer 114 and the paper discharging roller 151.

With the constitution, the image forming apparatus 1 of the present embodiment can carry out an image forming processing on a sheet which is too large to be stored in the paper feed section 13 using the manual sheet loading section 16.

The wall direction of the front side of the image forming apparatus 1 is described in the embodiment above as a first direction, however, the present invention is not limited to this, the wall direction facing the direction in which a user can carry out an operation easily may also be used as the first direction, depending on the configuration of the image forming apparatus 1.

Further, in the embodiment above, the wall direction on the right side of the image forming apparatus 1 is described as a second direction perpendicular to the first direction, however, the present invention is not limited to this, the second direction may further be the wall direction on the left side of the image forming apparatus 1.

In conclusion, with a constitution that a toner cartridge is inserted and detached in a direction different from the direction in which a processing unit is mounted and detached, the image forming apparatus described herein is downsized when compared with the conventional ones.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a paper feed section configured to store a sheet;

a toner cartridge which is detachably mounted from a first direction to store a toner;

a front wall having a first opening in the first direction of the image forming apparatus;

a processing unit which is detachably mounted from a second direction perpendicular to the first direction and is provided with a photoconductor, a developing section for supplying the toner fed from the toner cartridge to the surface of the photoconductor to convert an electrostatic latent image to a toner image and a cleaning section for collecting the toner adhered on the surface of the photoconductor;

a power supply section located nearby a wall in the first direction of the image forming apparatus to respectively supply power to the toner cartridge, the photoconductor, the developing section and the cleaning section;

a drive section located nearby a wall of the image forming apparatus opposite to the power supply section to respectively drive the toner cartridge, the photoconductor, the developing section and the cleaning section;

a conveyance section configured to convey the sheet from the paper feed section to the processing unit;

a conveyance path cover section configured to rotate between an opening position for exposing the conveyance section and a closing position covering the conveyance section to take out a sheet jammed in the conveyance section from the conveyance section; and a side wall having a second opening in the second direction of the image forming apparatus; wherein the drive section is located opposed to the power supply section along the first direction;

the toner cartridge and the processing unit are mounted so that the longitudinal direction of the toner cartridge and the processing unit is to be the first direction;

the processing unit can be detached when the conveyance path cover section is set at the opening position, and the processing unit is mounted or removed to the drive section and the power supply section by mounting or removing from the second direction; and the toner cartridge is still mounted on the image forming apparatus when the processing unit is detached from the image forming apparatus, the toner cartridge is exchanged via the first opening and the processing unit is exchanged via the second opening.

2. The image forming apparatus according to claim 1, further comprising:

an operation panel configured to operate the image forming apparatus, wherein the first direction is a direction of a wall of the image forming apparatus on which the operation panel is arranged.

3. The image forming apparatus according to claim 1, further comprising:

a charger which is detachably mounted on the image forming apparatus from the second direction to charge the photoconductor, wherein the charger is still mounted on the image forming apparatus when the processing unit is detached from the image forming apparatus.

* * * * *